United States Patent [19]

Rossello

[11] 4,420,270

[45] Dec. 13, 1983

[54] VISUAL DISPLAY PRESENTATION BOX

[75] Inventor: Henry S. Rossello, Mission Viejo, Calif.

[73] Assignee: McDonnell Douglas Corporation, Long Beach, Calif.

[21] Appl. No.: 423,294

[22] Filed: Sep. 24, 1982

[51] Int. Cl.[3] ..... A45C 3/02

[52] U.S. Cl. ..... 402/76; 190/900; 281/33

[58] Field of Search ..... 402/76, 70, 71, 72, 402/73, 74, 75, 77, 78, 79, 80 R, 501, 502, 503; 190/1, 11, 17, 16, 29, 30, 41 R, 4, 5, 6, 10, 48, 52; 150/1.5, 1.6; 40/359, 530, 531, 533, 534, 535, 536; 248/441, 445

[56] References Cited

U.S. PATENT DOCUMENTS

| | | | |
|---|---|---|---|
| 595,982 | 12/1897 | Waring | 281/33 |
| 860,514 | 7/1907 | Batten et al. | 402/79 |
| 1,197,610 | 9/1916 | Darling | 190/16 |
| 1,292,720 | 1/1919 | Dawson | 402/73 X |
| 1,577,697 | 3/1926 | Douglas | 281/33 |
| 1,675,406 | 7/1928 | Douglas | 281/33 |
| 1,702,357 | 2/1929 | Meilicke | 281/33 |
| 1,720,607 | 7/1929 | Reed | 281/33 |
| 1,734,898 | 11/1929 | Conrad | 402/77 X |
| 2,072,471 | 3/1937 | Wolford | 402/75 X |
| 2,147,773 | 2/1939 | Larson | 281/33 |
| 2,205,692 | 6/1940 | Johnson et al. | 248/445 |
| 2,286,128 | 6/1942 | Unger | 248/441 |
| 2,340,222 | 1/1944 | Johnson | 281/33 |
| 2,549,306 | 4/1951 | Greene | 40/536 |
| 2,739,825 | 3/1956 | Douglas | 281/33 |
| 2,776,150 | 1/1957 | Ericson | 281/33 |
| 2,962,825 | 12/1960 | Bravo et al. | 190/1 |
| 3,096,102 | 7/1963 | Wiands et al. | 281/33 |
| 3,136,082 | 6/1964 | Sloves | 281/33 |
| 3,220,752 | 11/1965 | Sloves | 281/33 |
| 3,311,202 | 3/1967 | Schell et al. | 190/16 |
| 4,222,190 | 9/1980 | Solomon | 402/75 X |
| 4,240,761 | 12/1980 | Jacobson | 402/76 |

*Primary Examiner*—Paul A. Bell
*Assistant Examiner*—John S. Brown
*Attorney, Agent, or Firm*—George W. Finch; John P. Scholl; Donald L. Royer

[57] ABSTRACT

A portfolio with a ring or other type binder for securing visual display material uniformly while being carried or during visual display presentations. This box-like portfolio features a double hinged top which, when mobilized by use of its pull strap feature, activates its lid and its internal members, opening the portfolio to form a unique presentation easel which serves to produce an impressive prelude to any visual display presentation.

8 Claims, 5 Drawing Figures

VISUAL DISPLAY PRESENTATION BOX

BACKGROUND OF THE PRESENT INVENTION

This invention in general pertains to an improved portfolio for storing, protecting, transporting, and displaying visual display material and, more specifically, to a binder for said material.

Typically, known portfolios require a means of support for various display angles desired by the presenter to obtain the best viewing position for presenting visual material to seated observers. In many portfolios, the contents are exposed on one or more sides, thus presenting a possibility of damage to portfolio contents. Further, transporting materials confined within the bounds of prior portfolios, with one or more sides open, may cause the tearing out of binder holes in the visual material if the portfolio should be dropped or violently handled, thus potentially entangling the pages of the visual material with foreign objects. Portfolios, bound on only one side, form a wedge sloped at various angles depending upon the thickness of the portfolio and the amount of display material contained therein. When it is desired to vertically stack multiple portfolios, this wedge shape may prevent uniform stacking. The wedge shape also inhibits uniform side-by-side storage or arrangement of the portfolios.

With most binders, loose leaf presentation of instructional, display or advertising material is cumbersome and often lacks professional quality desired for effective visual presentations.

BRIEF DESCRIPTION OF THE PRESENT INVENTION

The unique opening and closing action of this portfolio and the material confining capabilities of the case, which are created to protect the contents therein, accomplish the desired requirements of the portfolio and overcome the disadvantages of the prior described portfolios. Generally, the portfolio of the present invention may be transported in a manner similar to that of any basic attache case. Upon commencing a display presentation, the transition from a closed to an open configuration may be very smooth, rapid and effective.

It is an important object of the present invention to provide a protective housing for visual display material.

Another important object of this invention is to permit a smooth single motion stroke opening of a display portfolio whereby to display its contents in an orderly manner.

Another important object of this invention is to provide a display portfolio wherein movable members are self-supporting when in an open configuration and remain self-supporting while holding visual display material at various upright and desirable display angles.

Another important object of this invention is to provide a display portfolio that may be expeditiously retracted and closed in an orderly manner while completely enclosing visual material within the protective confines of the portfolio.

Another important object of this invention is to provide a display portfolio including various means to secure the open side, by latching, to form an attractive and protective case with a handcarrying attachment to enable ease in its transportation.

This unique arrangement for displaying, protecting and transporting visual display material places this invention in a superior class to prior portfolios.

DESCRIPTION OF THE INVENTION

Figure 1:
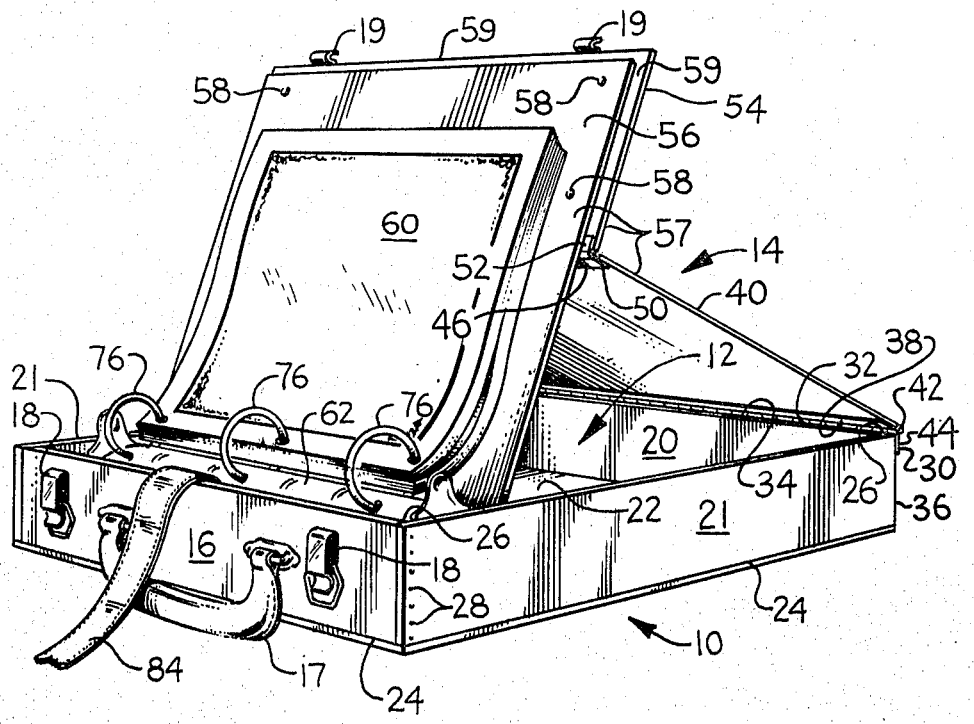
FIG. 1 is a perspective view of a preferred embodiment of the present invention.

The invention in its preferred embodiment is shown in a display configuration in FIG. 1, comprising a portfolio 10 and including a compartment 12 which houses movable display unit 14. The compartment 12 is composed of a front wall 16 to which is secured a handcarrying attachment 17 and one or more latches 18 which, when used in conjunction with one or more clasps 19, secures the portfolio into a firmly closed condition for transporting by handcarrying attachment 17. The compartment 12, is also composed of a rear wall 20, two side walls 21, and a bottom 22. The front wall 16, rear wall 20, two side walls 21 and bottom 22 are joined at bottom edges 24 and ends 26 by suitable fasteners such as brads 28, dowel pegs, sealant, etc. The fasteners, upon assembly with aforementioned members, become an integral part of the unit to form the four cornered compartment 12. Attached by suitable fasteners to the upper rear surface 32 of the rear wall 20, is the lower half of a strip hinge 30. Strip hinge 30, which spans the entire outer width of compartment outer case 34, overlaps rear edges 36 of side walls 21. The upper half of a strip hinge 38 is in turn attached to the rear under surface of aft lid section 40 by suitable fasteners. The upper half of a strip hinge 38 is then connected to the lower half of a strip hinge 30 by inserting a hinge pin 42 to form first operating hinge 44. In a like manner, a lower strip hinge half 46 is then attached to the forward under surface of aft lid section 40 by a suitable fastener and is connected to an upper strip hinge half 48 by hinge pin 50 to form second operating hinge 52. Operating hinge 52 is then attached to forward lid 54. Forward lid 54 primarily serves as an extension of aft lid 40 and a plate support for display plate 56 forming a lid assembly 57. Display plate 56 is attached to the undersurface of forward lid 54 by a plurality of rivets 58 or suitable fasteners. The display plate 56 is sized smaller than forward lid 54 and aft lid 40 to form a ledge 59 which, when portfolio is closed, will rest on the upper edges of front wall 16 and side walls 21 to prevent lateral movement. The display plate 56 is the preferred surface for displaying visual material 60, which is secured to binder assembly 62. Binder assembly 62 is of the conventional two or more ring type and is attached to a binder block which will be defined in FIGS. 2 through 5.

Figure 2:
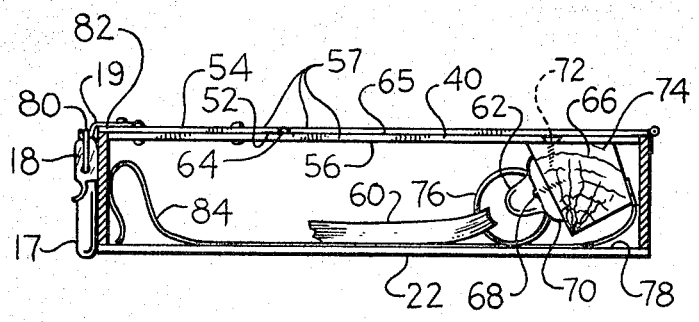
FIG. 2 is a side elevational view showing the position of the main elements of the invention in the closed configuration.

In the closed or carrying configuration, as shown in FIG. 2, a novel and unique feature of this invention becomes apparent. The junction 64 caused by the mating of forward lid 54 and aft lid 40 with second operating hinge 52 is rendered rigid by the doubling effect caused by the sandwich 65 formed by display plate 56 with forward lid 54 and aft lid 40 preventing any buckling tendency when stacking one on the other. Binder assembly 62 is attached to binder block 66 by a plurality of screws 68 inserted along the length of binder assembly body 70 and into binder block 66. Binder block 66, in turn, is attached to the display plate 56 by a plurality of flat head screws 72 along a beveled length 74 of the binder block 66. A further novel feature of this invention, in the closed configuration, is that the bevel 74 on binder block 66 places the rings 76 on the conventional ring binder 62 in contact with the upper surface 78 of the bottom 22 thus forming another rigid support through binder assembly 62 and binder block 66 for lid assembly 57. The bevel 74 also serves to place the binder assembly 62 parallel to the compartment bottom 22 while display plate 56 rests upright at a comfortable viewing angle when the invention is in the preferred fully open configuration. Clasp 19 when engaged with clasp hook 80 of latch 18 extends uniquely below the forward outer surface 82 of lid assembly 57 to maintain a relatively smooth top on the portfolio for stacking uniformally one on another.

Figure 3:
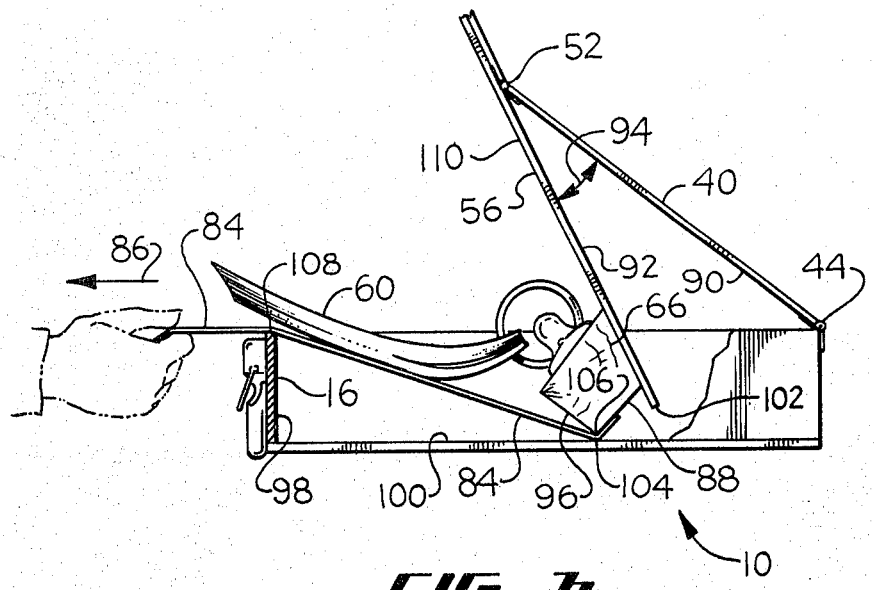
FIG. 3 is a side elevational view showing the response of the movable members to the opening motion illustrated by the operator's hand, which is shown in phantom lines.
Figure 4:
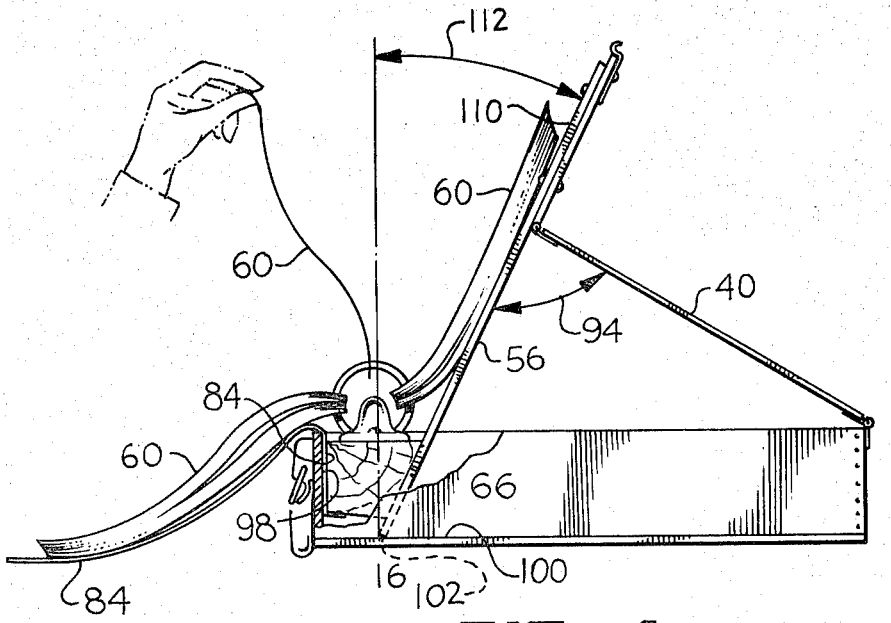
FIG. 4 is a side elevational view showing the position of the main elements of the portfolio while in an open configuration.

The hand movement applied to strap 84, in the direction indicated by arrow 86, as depicted in FIG. 3, begins a unique chain of events which results in the opening of the invention to its preferred visual display configuration. Strap 84, while being attached to the underside 88 of binder block 66, serves as a multipurpose member of the portfolio 10. While being pulled in the direction of arrow 86, strap 84 begins movement of binder block 66 and display plate 56. This movement activates a simultaneous movement of first hinge 44 and second hinge 52. This motion, in turn, causes a separation of the inner surface 90 of aft lid 40 and back surface 92 of display plate 56. The angle 94 between aft lid 40 and display plate 56 increases with the continuous pulling of strap 84 until the forward side 96 of binder block 66 is adjacent to the aft surface 98 of front wall 16. At this point, the movable unit may be nestled to the bottom inner surface 10 to rest on the lower edge 102 of the display plate 56, as will be shown more clearly in FIG. 4. Further pertaining to FIG. 3, the pull strap 84, during this motion sequence, also serves as a cushioning skid at point 104, preventing excess wear of the inner surface 100 of the bottom of compartment 22 and the lower edge 106 of the binder block 66. Further, during the pulling motion, the pull strap 84 serves as a guide for the visual display material 60, permitting the material 60 to ride smoothly up and over the top edge 108 of front wall 16, placing the material 60, when binder block 66 mates with front wall 16, completely outside of the compartment 12 and in position to be laid against front surface 110 of the display plate 56 for visual presentation. As shown in FIG. 4, the visual material 60, may readily be flipped back and forth, depending upon the requirements of the presentation. The display plate 56 will maintain the preferred presentation angle 112, due to the uniting of binder block 66 and pull strap 84 against aft surface 98 of front wall 16 and the propping effect of aft lid 40 which was achieved by the widening of angle 94. As aforementioned, the unit may now be rested on the lower edge 102 of display plate 56 on the inner surface of the bottom 100.

Figure 5:
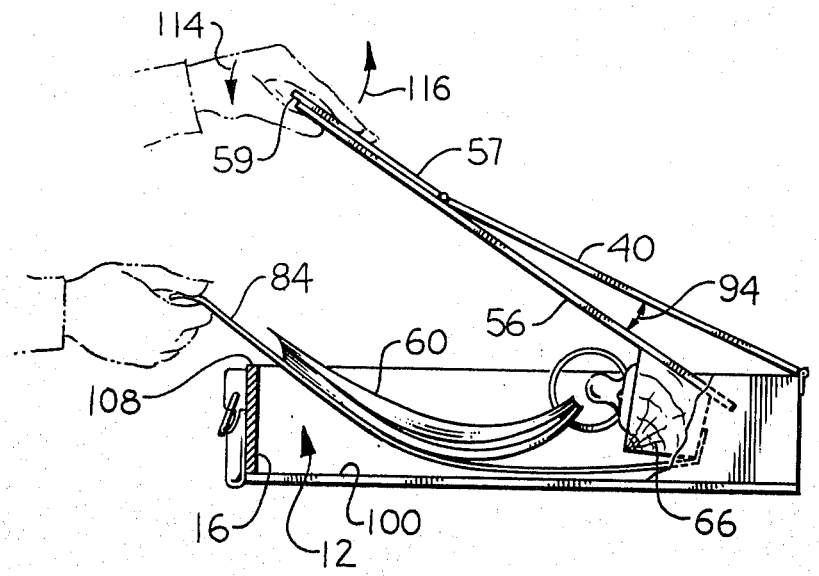
FIG. 5 is a side elevational view showing the response of the movable members to a closing motion.

The transition to the closed configuration, as depicted in FIG. 5, is unique in that the multipurpose pull strap 84, during the closing motion, serves as a cradle for visual material 60 to be lowered into the compartment 12 as a gentle rotation of the hand in the direction of the down arrow 114 and the fingers in the direction of the up arrow 116, swings the binder block 66 and display plate 56 clear and aft of front wall 16 and compartment bottom 100. To complete the closing motion, strap 84 is then tucked inside the compartment 12 and the lid assembly 57 is lowered to rest on ledge 59 atop the upper edge 108 of front wall 16. This motion completely closed angle 94 between aft lid 40 and display plate 56 to once again form the rigid sandwich 65 that was described in FIG. 2.

The novelty of design and utility of this invention should now be apparent and the unique motions achieved with only two points of mechanical movement surpasses known prior art designs.

What is claimed is:

1. A portfolio for housing, carrying, and displaying visual presentation materials including:

a rear wall portion; and a lid portion, said lid portion having:

a forward lid section;

an aft lid section;

first hinge means attaching said aft lid section to said rear wall portion;

second hinge means attaching said forward lid section to said aft lid section;

a display plate attached to said forward lid section;

means for attaching the visual presentation material to said display plate; and a bottom portion connected to said rear wall portion, said aft lid section having a closed position generally parallel to said bottom portion and an open position at a first predetermined angle to said bottom portion, said forward lid section having a closed position generally parallel to said bottom portion and an open position at a second predetermined angle to said bottom portion greater than said first predetermined angle, said display plate being attached to, and parallel to, said forward lid section and including:

a first edge positioned to be supported on said bottom portion when said forward lid section with said attached display plate are in the open position, said display plate forming a third predetermined angle with said bottom portion.

2. Said portfolio as defined in claim 1 wherein said means for attaching the visual display presentation material to said display plate include:

a support member attached to said display plate adjacent said first edge thereof; and mechanically operated means for insertion and removal of visual presentation material.

3. Said portfolio as defined in claim 2 further including:

a front wall portion having an inner abutment surface, said support member further including:

a first surface oriented parallel to said front wall portion inner abutment surface and closely adjacent thereto when said forward lid section with said attached display plate are in the open position; and a second surface generally at a right angle to said first surface to which said mechanically operated means for insertion and removal of visual presentation material are connected.

4. Said portfolio as defined in claim 3 further including:

a pull strap having:

an inner portion operatively connected to said means for attaching the visual presentation material to said display plate, said inner portion being positioned between said bottom portion and said support member when said forward lid section with said attached display plate are being moved from the closed position to the open position so that said strap acts as a skid for said support member and said bottom portion;

an outer portion for application of manual force to move said forward lid section with said attached display plate to the open position; and an upper surface which cradles and guides the visual presentation material over said front wall portion during the application of manual force to move said forward lid section with said attached display plate to the open position.

5. Said portfolio as defined in claim 3 further including:

a peripherial ledge formed on said aft lid section and said forward lid section, about said display plate.

6. Said portfolio as defined in claim 5 further including:

a first side wall portion attached to said front wall portion, said bottom portion and said rear wall portion; and a second side wall portion attached to, said front wall portion, said bottom portion and said rear wall portion, whereby said first and second side wall portions and said front wall portion abut said peripherial ledge when said forward lid section and said aft lid section are in the closed positions to provide support therefor.

7. Said portfolio as defined in claim 6 wherein, said first and second hinge means each are piano hinges.

8. Said portfolio as defined in claim 7 wherein said forward lid section includes:

a top surface; and, a bottom surface on which said peripheral ledge is formed further including:

a latching mechanism, for securing said forward lid portion and said aft lid portion to said front wall portion, comprised of:

a pair of latch hooks attached to said top surface, said latch hooks having:

grasps extending from said forward lid section top surface toward said bottom surface; and a pair of mechanically operated latches attached to said front wall portion, located to engage said grasps of said pair of said latch hooks; and a handle attached to said front wall portion.

* * * * *